US006397398B1

(12) United States Patent
Herder

(10) Patent No.: US 6,397,398 B1
(45) Date of Patent: Jun. 4, 2002

(54) REMOVABLE POCKET AND ATTACHMENT

(76) Inventor: Denise Herder, 715 Sanders St., Burlington, KS (US) 66839

( * ) Notice: Subject to any disclaimer, the term of this patent is extended or adjusted under 35 U.S.C. 154(b) by 0 days.

(21) Appl. No.: 09/835,998

(22) Filed: Apr. 16, 2001

Related U.S. Application Data

(60) Provisional application No. 60/197,637, filed on Apr. 17, 2000.

(51) Int. Cl.[7] ..... A41D 27/20

(52) U.S. Cl. ..... 2/249; 24/3.1

(58) Field of Search ..... 2/247–252, 69, 2/115, 227, 908, 920; 24/3.1, 304; 40/594, 775, 760, 661.09

(56) References Cited

U.S. PATENT DOCUMENTS 3,624,686 A * 11/1971 Beals ..... 35/8 R
4,389,801 A * 6/1983 Sharrock et al. ..... 40/159
4,651,355 A * 3/1987 White ..... 2/247
5,054,127 A * 10/1991 Zevchak ..... 2/247
5,499,403 A * 3/1996 Harrigan ..... 2/247
5,774,892 A * 7/1998 Tisdale et al. ..... 2/69

* cited by examiner

*Primary Examiner*—Gloria M. Hale
*Assistant Examiner*—Tejash Patel
(74) *Attorney, Agent, or Firm*—Robert Ryan Morishita; Anderson & Morishita

(57) ABSTRACT

A removable storage pocket is securable to the surface of an object. The pocket includes a front panel and a rear panel secured to one another around the margins thereof to form a pocket. The pocket is secured to the object using a mating fastener having first and second removably mating elements. Optionally, the fastener is a hook and pile fastener. A first element of said mating fastener is secured to the rear surface of the rear panel around a portion of the margin thereof. Optionally, the first fastener element surrounds less than all the margin of the rear panel. A second element of said mating fastener is removably adhered to the surface of said object using adhesive having a bonding strength greater than the force required to disengage the mating fastener. The second mating fastener element is positioned on the object surface in a shape substantially congruent to the configuration of the first element on the rear panel such that when the mating fastener elements are engaged, the pocket formed by the cooperating panels is removably secured to the object.

4 Claims, 3 Drawing Sheets

REMOVABLE POCKET AND ATTACHMENT

RELATED APPLICATION DATA

The present application claims the priority of U.S. Provisional Application Serial No. 60/197,637, entitled "Clothing Accessory," filed Apr. 17, 2000 by Applicant herein.

FIELD OF THE INVENTION

The present invention relates to removable pockets. More specifically, the present invention is pocket that is removably secured to an object such as an article of clothing, bag, or the like.

BACKGROUND OF THE INVENTION

It is well known in the art to provide permanent pockets on objects such as clothing, bags, and the like. However, these pockets are typically secured to the object in a permanent fashion such as with stitching or thermally activated adhesive, i.e. "iron-on" type glues and hot glues. Thus, these pockets cannot be easily removed from the object and, more importantly, cannot be easily moved from one location to another on the object.

Similarly, for clothing and other objects without pockets, it may require skill and time to attach a pocket. In the example above, to create a pocket on an object without a pocket, one would be required to cut a pocket panel, finish the edge of the pocket panel, and stitch or otherwise attach the pocket panel to the object. As can be appreciated, most people do not have the time, skill, or equipment required to attach a pocket to pocketless objects in this manner.

While low bonding strength adhesives, that is removable adhesives, could be used to create removable pockets, it is well appreciated in the art that these adhesives have a tendency to lose their efficacy with repeated use. More importantly, when adhered to the object, removable adhesives, like all adhesives, have a greater bonding strength against shear forces than normal forces. Thus, removable adhesives could disengage when an object is placed in the pocket that causes the pocket to stretch thereby placing normal stresses on the adhered surfaces.

It can therefore be appreciated that there is a need in the art for a removable pocket that may be secured to an object in a fashion that will secure the pocket against unwanted disengagement but permits removal and movement to other locations or objects.

SUMMARY OF THE INVENTION

A removable storage pocket that is securable to the surface of an object includes a front panel, a rear panel and a mating fastener. Each panel has front and rear surfaces. The panels may be formed from any suitable thin, sheet-like material. Such suitable materials may include cloth fabric, polymer fabric, polymer sheet, or the like. The front surface of the rear panel is secured to the rear surface of the front panel around the margins thereof to form a storage pocket.

The mating fastener is of a type that includes first and second mating elements that can be removably engaged to one another. In an optional embodiment, the fastener is a hook and pile fastener such as that sold under the trademark Velcro™. A first element of the mating fastener is secured to the rear surface of the rear panel. In an optional embodiment, the first mating fastener element is permanently secured to the rear panel. As is known in the art, the first mating fastener element may be permanently secured to the panel using stitching, adhesives, or the like.

The second element of the mating fastener is removably adhered to the object surface. The adhesive used to adhere the second mating fastener element to the object surface has a bonding strength greater than the force required to disengage the mating fastener. In other words, an adhesive is used that permits disengagement of the mating fastener but permits removal of the second fastener element from the object if desired. The second mating fastener element is positioned on the object surface in a shape substantially congruent to the configuration of the first element on the rear panel. In a further optional embodiment, the first fastener element is disposed around less than all the margin of the rear surface of the rear panel, such as at the top of the rear panel. In this fashion, when the mating fastener elements are engaged, the storage pouch formed by the cooperating front and rear panels is removably secured to the surface of the object.

It is an object of the present invention to provide a removable storage pocket that can be secured to an object in a secure yet removable fashion.

DESCRIPTION

Reference is now made to the figures wherein like parts are referred to by like numerals throughout. Referring to FIGS. 1–5, the present invention is adapted to be secured to the surface of an object 22. As described above, the storage pocket 10 of the present invention could be secured to many types of objects such as clothing, bags, and the like.

Figure 2:
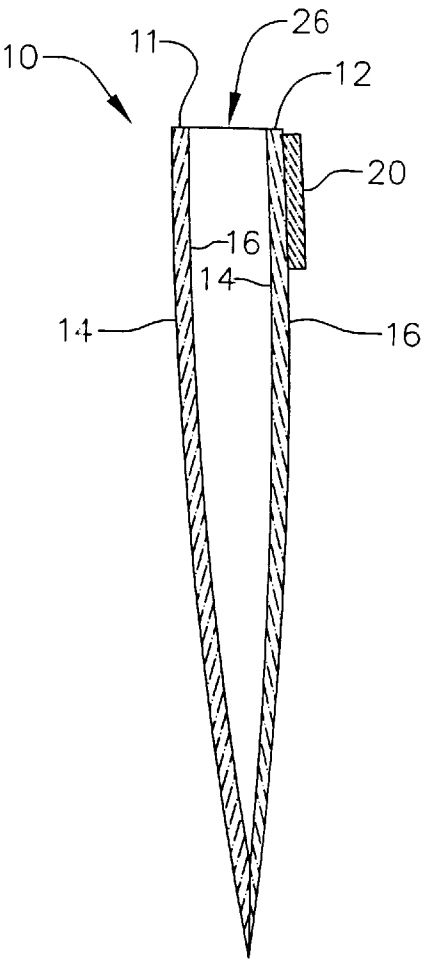
FIG. 2 is a cutaway side view of a storage pocket taken along section line A—A of FIG. 1.
Figure 1:
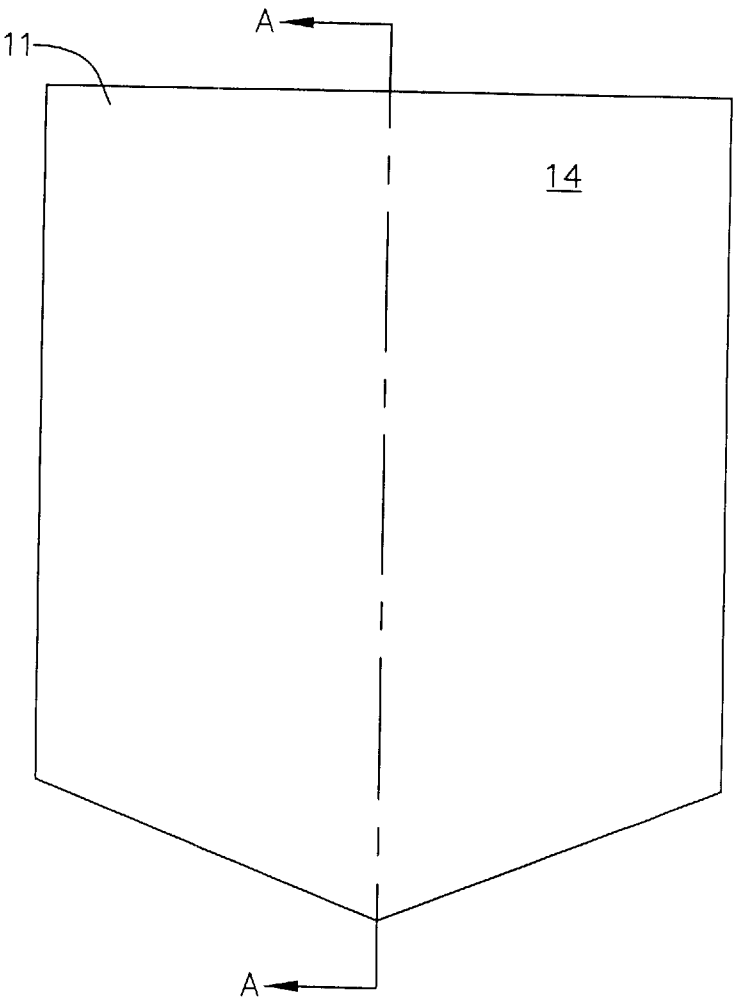
FIG. 1 is a front view of a storage pocket according to an embodiment of the present invention.
Figure 3:
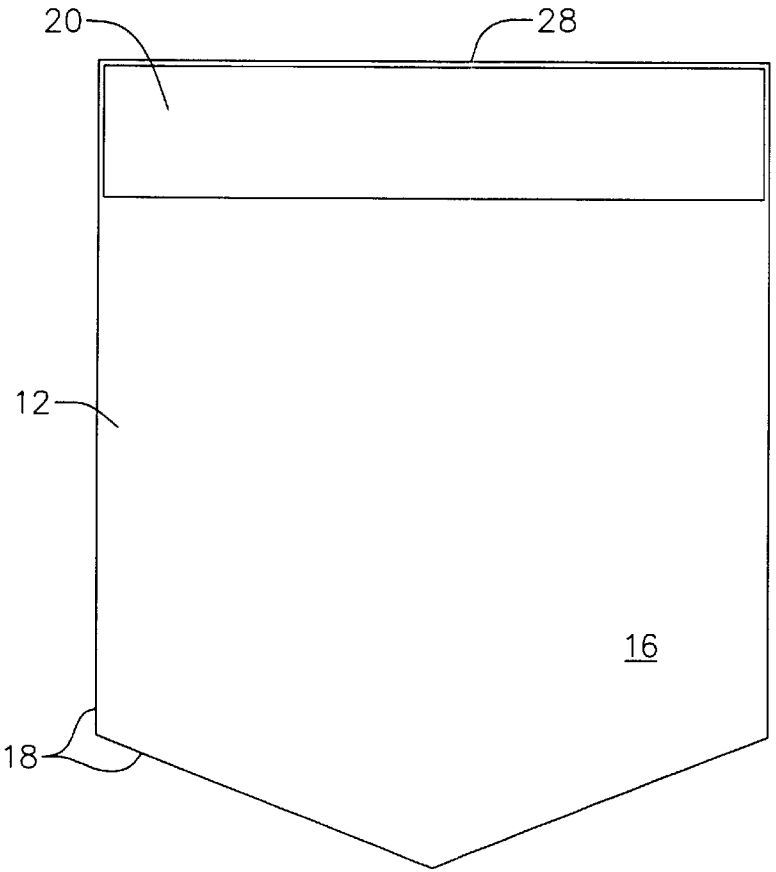
FIG. 3 is a rear view of a storage pocket according FIG. 1.

With reference to FIGS. 1–3, the storage pocket 10 includes three components, a front panel 11, a rear panel 12, and a mating fastener. The panels 11, 12 are formed from thin, sheet-like material. It is contemplated that the panels 11, 12 could be cloth fabric, polymer fabric, polymer sheet, or any other type of thin material. While the panels 11, 12 of FIGS. 1 and 2 are of conventional pocket shape, i.e. pentagonal, the panels 11, 12 could take any shape. Similarly, it is contemplated that the panels 11, 12 need not have the same shape or size as one another. As shown in FIGS. 1–3, the panels 11, 12 each includes a front surface 14 and a rear surface 16.

The front panel 11 and rear panel 12 are each defined by margins 18. To form the storage pocket 10, the front surface 14 of the rear panel 12 is placed adjacent the rear surface 16 of the front panel 11 and the margins 18 of the rear panel 12 are secured to the front panel 11 to form a storage pocket 10 therebetween. The attachment could take a variety of forms including adhesive, bonding, stitching, or the like. In other words, the front panel 11 and the rear panel 12 are attached to one another to cooperate to form a storage pocket 10. As can be appreciated, the attachment between the front panel 11 and the rear panel 12 runs around less than the entire margins 18 such that an opening 26 for accessing the storage pocket 10 remains.

With continued reference to FIGS. 1 and 2, the mating fastener is of a type having two mating elements, a first mating fastener element 20 and a second mating fastener element 24, that may be removably secured to one another. For example, in an optional embodiment, the mating fastener is a hook and pile fastener such as that sold under the trademark Velcro™. As shown in FIG. 2, in one optional embodiment, the mating fastener is of the type that may form a continuous seam when engaged. However, it is also contemplated that the mating fastener may be one or more discrete fasteners.

The first element 20 of the mating fastener is secured to the rear surface 16 of the rear panel 12. In an optional embodiment, the first mating fastener element 20 is permanently secured to the rear surface 16 through stitching, bonding, adhering, or the like. While the first mating fastener element 20 could be disposed in any configuration, in an optional embodiment, the first mating fastener element 20 is positioned at the upper margin 28 of the rear panel 12.

Figure 4:
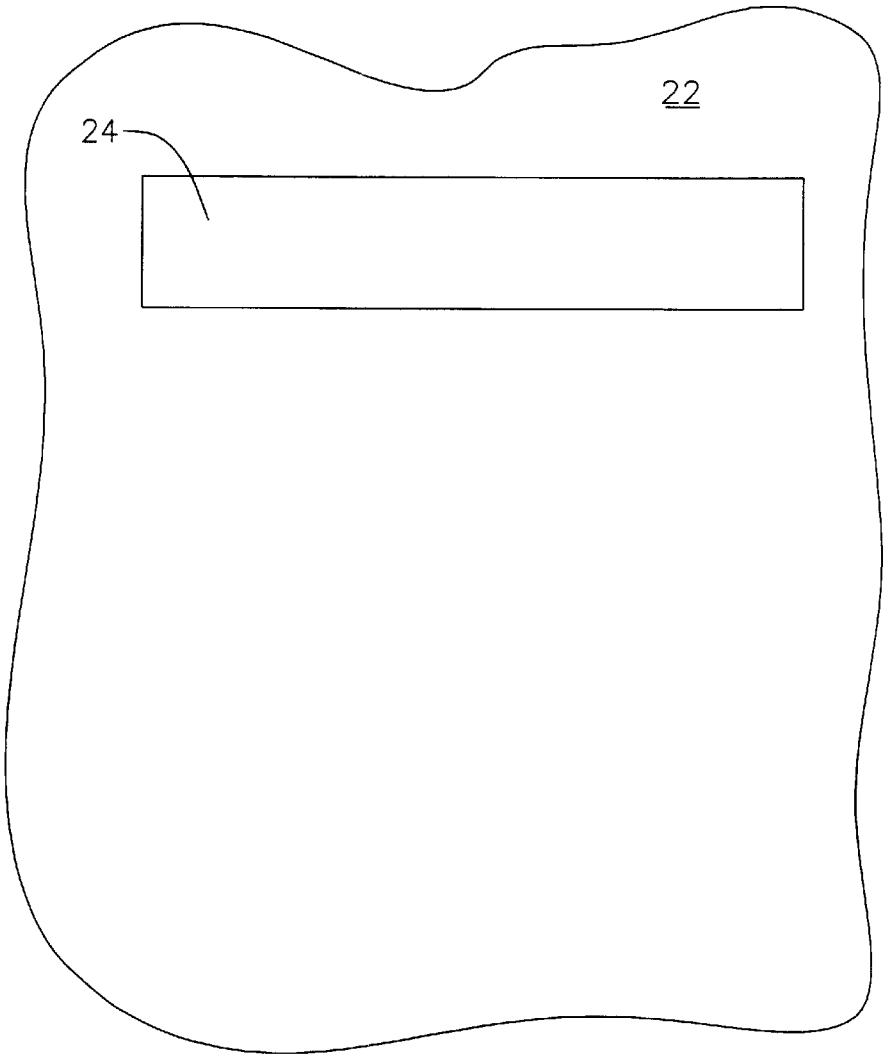
FIG. 4 is a front view of an object with a mating fastener element thereon according to an embodiment of the present invention.

As shown in FIG. 4, the second element 24 of the mating fastener is removably adhered to the surface of the object 22. The adhesive used to adhere the second mating fastener element 24 to the object 22 has a bonding strength greater than the force required to disengage the mating fastener elements 20, 24. Thus adhered, the storage pocket 10 may be removed as desired, such as during washing, while leaving the second mating fastener element 24 secured to the object surface 22. In other words, an adhesive is used that will hold the second mating fastener element 24 to the object 22 when the mating fastener elements 20, 24 are disengaged while also permitting removal of the second mating fastener element 24 if desired so that the second mating fastener element 24 may be placed at another location on the object 22 or on another object altogether.

Figure 5:
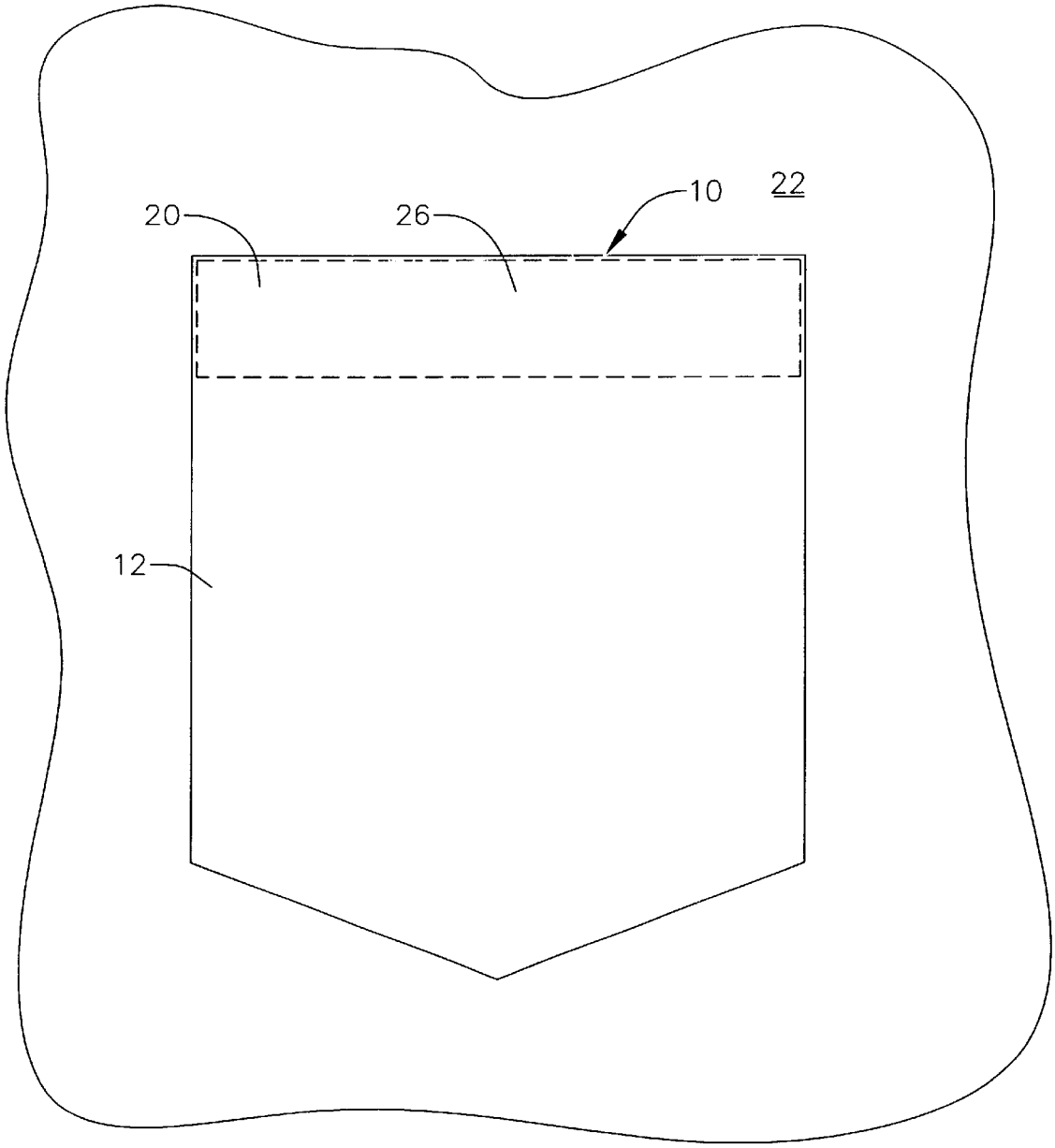
FIG. 5 is a front view of a storage pocket according to FIG. 1 mounted to the surface of an object.

In use, the second mating fastener element 24 is adhered to the object surface 22 in a position and orientation substantially congruent to the configuration of the first element 20 on the rear panel 12 as shown in FIG. 4. Thus, when the fastener elements 20, 24 are matingly engaged to one another, as shown in FIG. 5, the storage pocket 10 formed by the panels 11, 12 is removably secured to the surface of the object 22.

While certain embodiments of the present invention have been shown and described it is to be understood that the present invention is subject to many modifications and changes without departing from the spirit and scope of the claims presented herein.

I claim:

1. A removable storage pocket securable to the surface of an object, comprising:

a front panel;

a rear panel having front and rear surfaces, the rear panel defined by panel margins, the rear panel secured to said front panel around the panel margins; and a mating fastener having first and second removably mating elements, a first element of said mating fastener secured to the rear surface of said rear panel and a second element of said mating fastener removably adhered to the surface of said object using adhesive having a bonding strength greater than the force required to disengage the mating fastener such that said first and second element are disengaged from one another without dislodging said second element while still permitting said second element to be removed from said object, said second element positioned on said object surface in a shape substantially congruent to the configuration of the first element on the rear panel such that when said mating fastener elements are engaged, the pocket formed by the cooperating front and rear panels is secured to the surface of the object.

2. The storage pocket of claim 1 wherein a first element of the mating fastener is a strip secured to said rear panel only at an upper margin thereof.

3. The storage pocket of claim 1 wherein said mating fastener comprises strips of hook and pile fastener.

4. The storage pocket of claim 1 wherein said object is an article of clothing and said surface to which said second element is secured is on the interior of the clothing.

* * * * *